US008516835B2

(12) United States Patent
Holter

(10) Patent No.: US 8,516,835 B2
(45) Date of Patent: Aug. 27, 2013

(54) ICE CUBE TRAY AND METHOD FOR RELEASING A SINGLE CUBE FROM TRAY

(76) Inventor: Edward Carl Holter, Huntsville, AL (US)

( * ) Notice: Subject to any disclaimer, the term of this patent is extended or adjusted under 35 U.S.C. 154(b) by 677 days.

(21) Appl. No.: 12/098,910

(22) Filed: Apr. 7, 2008

(65) Prior Publication Data

US 2009/0249805 A1 Oct. 8, 2009

(51) Int. Cl.
*F25C 5/08* (2006.01)
*B22C 9/20* (2006.01)

(52) U.S. Cl.
USPC ..... 62/73; 62/349; 62/350; 249/119; 249/127; 249/133

(58) Field of Classification Search
USPC ..... 62/73, 349, 350, 6, 71; D12/90; D15/90; 249/119, 127, 133
See application file for complete search history.

(56) References Cited

U.S. PATENT DOCUMENTS

| | | | | |
|---|---|---|---|---|
| 1,908,323 | A | 10/1928 | Corbett | |
| 1,909,030 | A * | 5/1933 | Wheeland | 62/350 |
| 2,345,206 | A | 12/1941 | Mallard | |
| 2,407,058 | A * | 9/1946 | Clum | 62/137 |
| 2,594,127 | A | 5/1951 | Collier | |
| 3,374,982 | A | 3/1968 | Sallade | |
| 3,736,767 | A * | 6/1973 | Lukes | 62/349 |
| 4,023,768 | A | 5/1977 | Herrera-Casasus | |
| 4,255,941 | A | 3/1981 | Bouloy | |
| 4,366,941 | A | 1/1983 | Harris | |
| 4,372,523 | A | 2/1983 | McCartney | |
| 4,372,526 | A | 2/1983 | Daenen et al. | |
| 4,432,529 | A | 2/1984 | McMillan | |
| 4,942,742 | A | 7/1990 | Burruel | |
| 5,188,744 | A | 2/1993 | Silverman | |
| 5,253,487 | A * | 10/1993 | Oike | 62/353 |
| 5,364,063 | A | 11/1994 | Nishimura et al. | |
| 5,397,097 | A | 3/1995 | Dale | |
| 5,425,248 | A * | 6/1995 | Trantina | 62/349 |
| 5,830,379 | A * | 11/1998 | Tunzi | 249/126 |
| 6,168,131 | B1 | 1/2001 | Tabatabaie | |
| 6,196,518 | B1 | 3/2001 | Garrido-Lecca et al. | |
| 6,357,720 | B1 | 3/2002 | Shapiro et al. | |
| 2005/0151050 | A1 | 7/2005 | Godfrey | |
| 2005/0199776 | A1 | 9/2005 | Huang | |
| 2006/0117784 | A1 * | 6/2006 | Yang | 62/340 |

OTHER PUBLICATIONS

International Search Report and Written Opinion issued May 28, 2009 in corresponding International Application No. PCT/US2009/038727 filed Mar. 30, 2009.

* cited by examiner

*Primary Examiner* — Frantz Jules
*Assistant Examiner* — Cassey D Bauer
(74) *Attorney, Agent, or Firm* — Ann I. Dennen; Lanier Ford Shaver & Payne P.C.

(57) ABSTRACT

An ice tray in accordance with the present disclosure has an ice cavity formed on a first side for receiving water and creating an ice cube and a water cavity formed on a second side, the water cavity adjacent the ice cavity such that when warm water is poured in the water cavity, heat transfers to the ice cavity and melts the ice cube.

6 Claims, 4 Drawing Sheets

ICE CUBE TRAY AND METHOD FOR RELEASING A SINGLE CUBE FROM TRAY

Non-Provisional Patent Application Under 35 U.S.C. §111 (a) and 37 C.F.R. §1.53(b) In the United States Patent and Trademark Office

BACKGROUND OF THE INVENTION

Some conventional ice trays are made of plastic and have a plurality of cavities for creating ice cubes. Once the ice is formed, a user typically twists the plastic ice tray to pop the formed ice cubes out of the ice tray. When this is done, usually more than enough ice cubes are dislodged or not enough ice cubes are dislodged. In addition, the ice tray may break as a result of the force of the twisting.

SUMMARY OF THE INVENTION

An ice tray in accordance with an embodiment of the present disclosure comprises an ice cavity formed on a first side for receiving water and creating an ice cube; and a water cavity formed on a second side, the water cavity adjacent the ice cavity such that when warm water is poured in the water cavity, heat transfers to the ice cavity and melts the ice cube.

A method in accordance with an embodiment of the present disclosure can be conceptualized by the following steps: 1) creating ice cubes in an ice tray, the ice cubes on a first side of the ice tray; 2) turning the tray over; 3) pouring warm water into at least one water cavity formed on a second side, the water cavity adjacent the ice cavity such that when warm water is poured in the water cavity, heat transfers to the ice cavity and melts the ice cube; and 4) retrieving the ice cube.

BRIEF DESCRIPTION OF THE DRAWINGS

The invention can be better understood with reference to the following drawings. The elements of the drawings are not necessarily to scale relative to each other, emphasis instead being placed upon clearly illustrating the principles of the invention. Furthermore, like reference numerals designate corresponding parts throughout the figures.

DETAILED DESCRIPTION OF THE INVENTION

Figure 1:
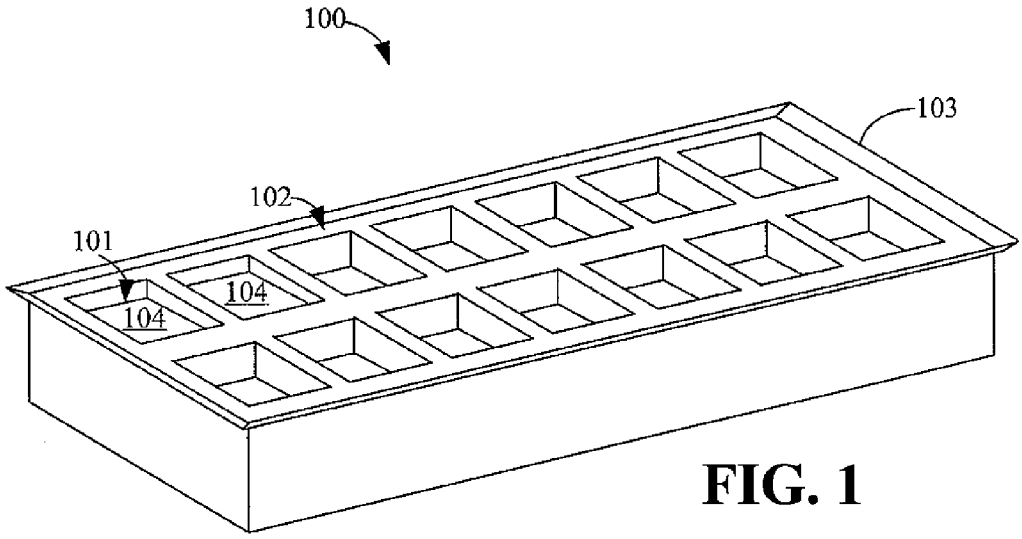
FIG. 1 is a perspective view of a top of an ice tray in accordance with an embodiment of the present disclosure.

FIG. 1 is a top perspective view of an ice tray 100 in accordance with an embodiment of the present disclosure. The ice tray 100 may be made of any type of material known in the art or future-developed, including plastic or metal.

The ice tray 100 comprises a plurality of cavities 101 within a top surface 102 of the ice tray 100. The cavities 101 are shown in two rows of seven cavities 101. However, other numbers of cavities 101 are possible in other embodiments.

The ice tray 100 is used to make one or more ice cubes 104. In this regard, water (not shown) is poured into one or more of the cavities 101. The ice tray 100 is placed in a freezer (not shown), and the water freezes into the ice cubes 104. Once the ice cubes 104 are formed, a user (not shown) removes the ice tray 100 from the freezer.

The ice tray 100 further comprises a lip 103. The lip 103 is contiguous with the top side 102. Further, the lip 103 outlines the periphery of the top side 102, and the lip 103 extends from the periphery outwardly at an angle, e.g., at a forty-five degree angle from the periphery. The lip 103 ensures that water poured into the cavities 101 does not escape when in use. The lip 103 is described further with reference to FIG. 4.

Figure 2:
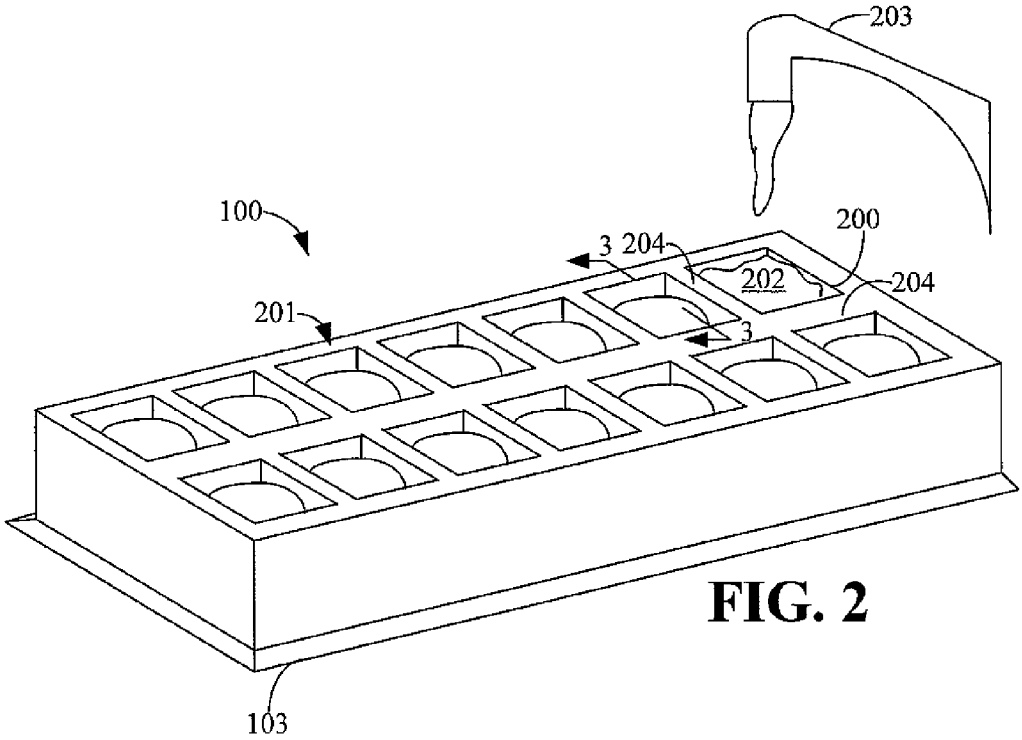
FIG. 2 is a perspective view of a bottom of the ice tray depicted in FIG. 1.

FIG. 2 is a bottom perspective view of the ice tray 100 depicted in FIG. 1. As shown with reference to FIG. 2, the ice tray 100 further comprises one or more cavities 200 on a bottom side 201. The cavities 200 are formed and separated one from the other by perpendicular walls 204.

In one embodiment, the number of cavities 200 is equivalent to the number of cavities 101 (FIG. 1) on the top side 102 (FIG. 1). Notably, in such an embodiment, each of the cavities 200 is adjacent to the one or more cavities 101 in a one-to-one ratio. Thus, for each cavity 101 on the top side 102 in FIG. 1 there is a corresponding adjacent cavity 200 on the bottom side 201.

A user (not shown) pours warm or hot water 202 in one or more of the cavities 200 for example via a faucet 203. Heat from the warm water 202 in the cavity 200 transfers to the adjacent cavity 101 on the top side 102, which has within it an ice cube 104 (FIG. 1). Once the cavity 101 and the ice cube 104 are warmed enough to melt a portion of the ice cube 104, the ice cube 104 drops from the cavity 101 through force of gravity, e.g., into a glass (not shown).

As noted herein, the perpendicular walls 204 form the cavities 200. If a user desires to only dislodge one ice cube 104 from the ice tray 100, the user can fill only one of the cavities 200 associated with the ice cube 104 that the user is trying to dislodge. Thus, the user can dislodge all of the ice cubes 104 or only a portion.

Figure 3:
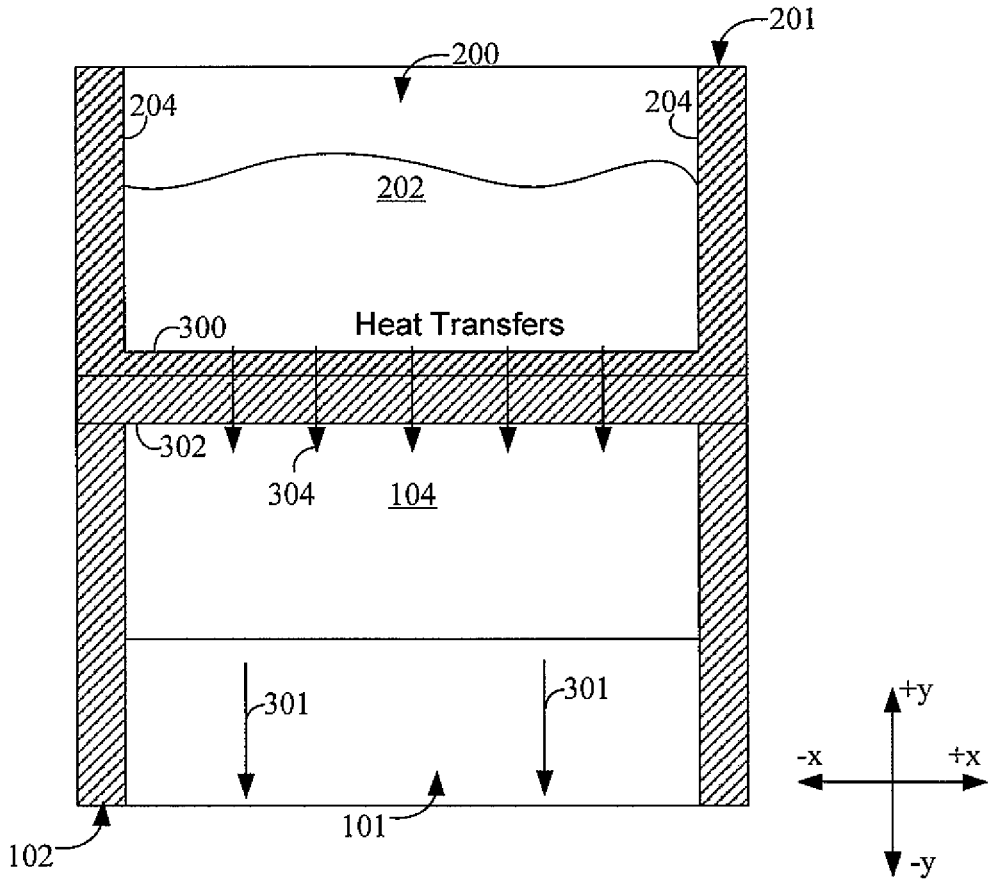
FIG. 3 is a cross sectional plan view of a cube cavity and water cavity of the ice tray depicted in FIG. 1 in accordance with an embodiment of the present disclosure.

FIG. 3 is a cross-sectional view of an embodiment of the cavities 101 and 200 taken along line 3-3 in FIG. 2. FIG. 3 depicts the ice cube 104 within the cavity 101 and warm water 202 that has been poured in the cavity 200.

The cavity 200 is shown in FIG. 3 as having a rectangular shape. However, other shapes of the cavity 200 are possible in other embodiments. The cavity 200 comprises an innermost wall 300 that is adjacent an innermost wall 302 of the cavity 101. The innermost wall 300 may have other shapes in other embodiments, for example the innermost wall 300 may be curvilinear.

For illustrative purposes, the cavity 101 is pointing in a −y-direction, which will be assumed pointing toward the center of earth. Thus, gravitational forces, indicated by reference arrows 301, are at work on the ice cube 104.

The warm water 202 heats the innermost wall 300. Resulting heat indicated by reference arrows 304 transfers through the innermost wall 302 into the cavity 101. As more and more heat transfers into the cavity 101, the ice cube 104 begins to melt. Once the ice cube 104 has melted enough to pull away from the cavity 101, the ice cube 104 falls from the cavity 101, for example into a glass (not shown), in a −y-direction.

Figure 4:
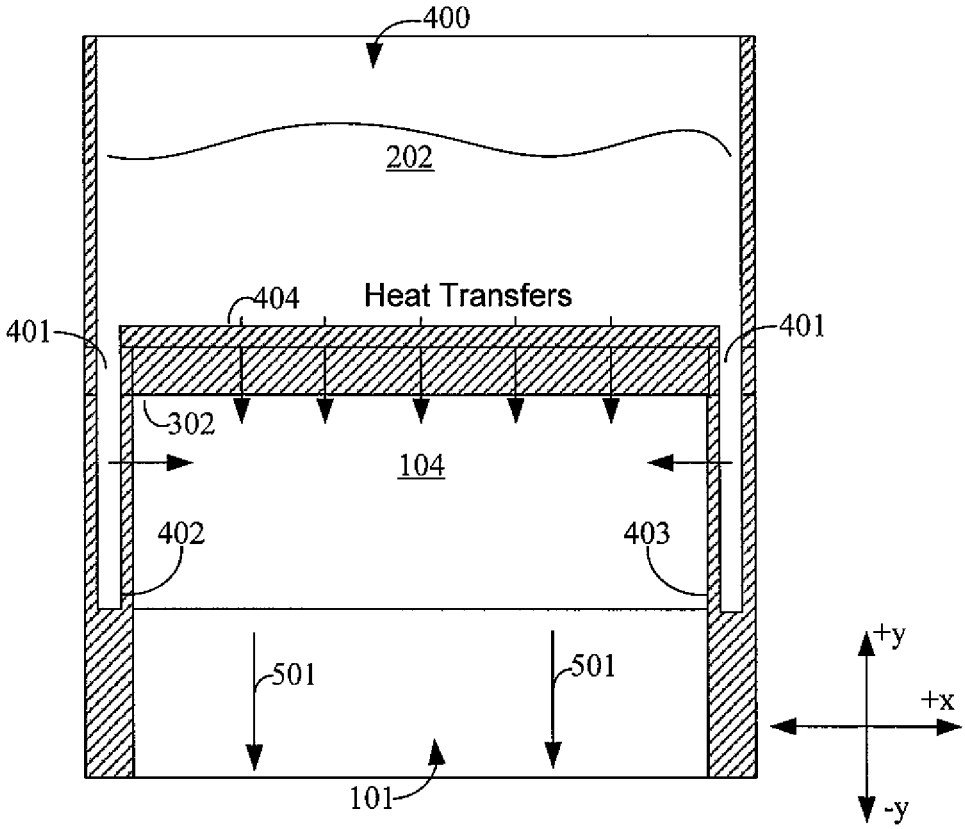
FIG. 4 is a cross-sectional plan view of another embodiment of the cube cavity and the water cavity.

FIG. 4 depicts a cross-sectional view of another embodiment of the present disclosure. In such an embodiment, cavity 101 is rectangular within which is an ice cube 104. However, in such an embodiment, a cavity 400 further comprises a channel 401 that extends at least about the walls 402 and 403 and is contiguous with the cavity 400.

Thus, as described herein, the warm water 202 heats the innermost wall 404 and heat transfers to the cavity 101 through the innermost wall 302. In addition, the warm water 202 flows into the channel 401. The warm water 202 in the channel 401 heats the walls 402 and 403 and heat transfers through walls 402 and 403 into the cavity 101.

As more and more heat transfers into the cavity 101 through walls 302, 402, and 403, as indicated by reference arrows 304, the ice cube 104 begins to melt. Once the ice cube 104 has melted enough to pull away from the cavity 102, the ice cube 104 falls from the cavity 102, for example into a glass (not shown), in a –y-direction.

Figure 5:
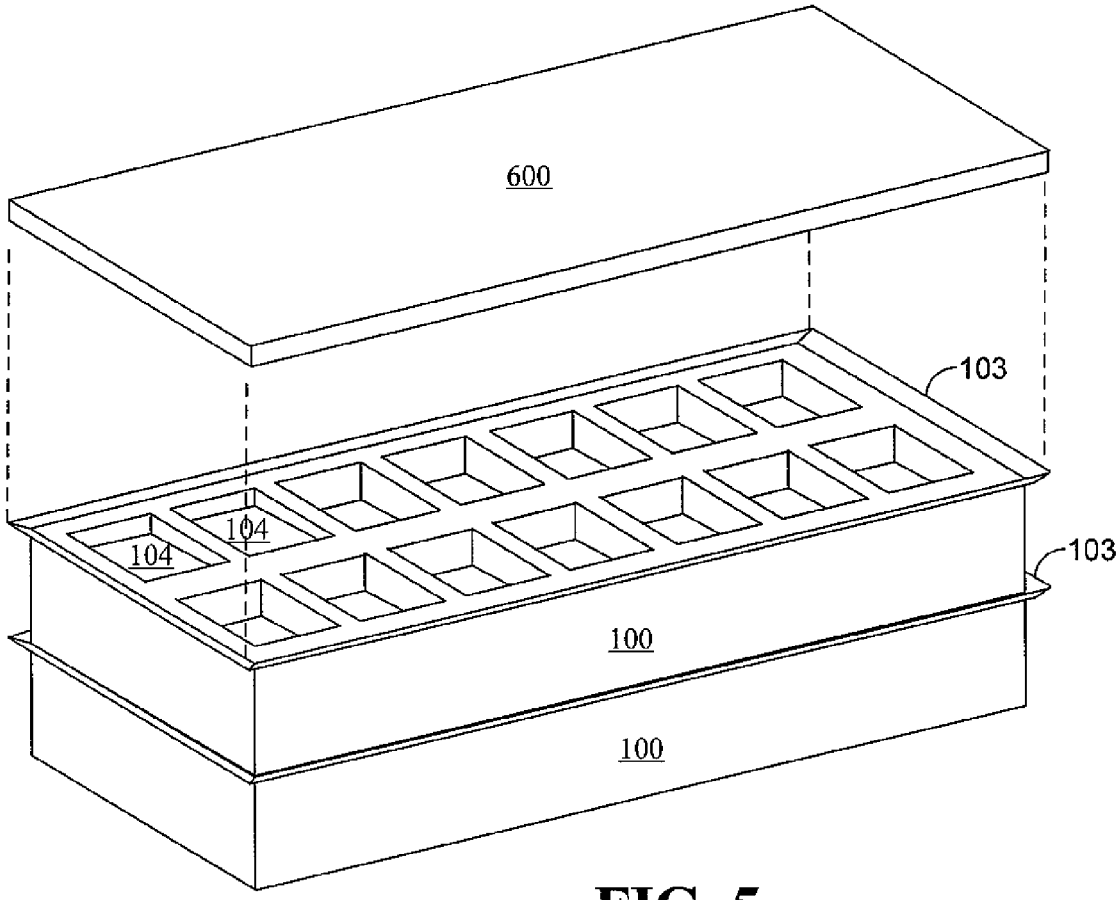
FIG. 5 is a perspective view of a plurality of stacked ice trays in accordance with an embodiment of the present disclosure.

FIG. 5 depicts two ice trays 100 stacked one upon the other. In this regard, as described with reference to FIG. 1, each tray 100 comprises the lip 103. Each ice tray 100 fits on top of the lip 103 of the subsequent ice tray 100. Thus, the ice trays 100 can be stacked modularly in a freezer.

In addition, FIG. 5 depicts an ice tray lid 600. The ice tray lid 600 fits snugly around the lip 103. Therefore, the ice 104 in the uppermost ice tray 100 is protected from freezer burn as well as ice cubes (not shown) in any bottom tray 100 that is protected by an ice tray above it.

Now, therefore, the following is claimed:

1. An ice tray, comprising:

an ice cavity formed on a first side for receiving water and creating an ice cube, the ice cavity having a rectangular cavity portion, unmovable, inflexible, and rigid outermost walls, and an unmovable, inflexible, and rigid floor; and a plurality of rectangular water cavities formed on a second side, the plurality of water cavities adjacent the ice cavity, rectilinear, unmovable, inflexible, and rigid channels that extend perpendicularly from the plurality of water cavities that are adjacent the outermost walls of the ice cavity and the floor separating the ice cavity from the plurality of water cavities, the channels contiguous with and in fluid communication with the plurality of water cavities, the plurality of water cavities are separated by corresponding walls, such that water can be poured into one of the water cavities without entering another one of the water cavities such that when warm water is poured in the plurality of water cavities the water flows into the channels and heat from the water transfers to the ice cavity through the through the outermost walls and the floor and begins to melt the ice cube, wherein the ice cube automatically falls from the ice cavity without movement of the floor and the outermost walls when the ice tray is manually rotated so that the water cavity faces upward and the ice cavity faces downward.

2. The ice tray of claim 1, further comprising a plurality of ice cavities formed on the first side.

3. The ice tray of claim 1, further comprising a lip that extends about a periphery of the first side.

4. The ice tray of claim 3, wherein the lip is for receiving another ice tray to form a stack of ice trays.

5. The ice tray of claim 3, wherein the lip is for receiving a lid.

6. A method, comprising:

creating ice cubes in a rectangular ice cavity in an ice tray having unmovable, inflexible, and rigid outermost walls and an unmovable, inflexible, and rigid floor, the ice cavity on a first side of the ice tray;

manually turning the tray over;

pouring warm water into a water cavity in the ice tray adjacent the ice cavity, the water cavity having a rectangular portion and rectilinear channels extending perpendicularly from the rectangular portion, the rectilinear channels contiguous with and in fluid communication with the water cavity such that when warm water is poured in the water cavity the water flows into the channels, the rectilinear channels adjacent the outermost walls of the ice cavity formed on a second side of the ice tray and the floor separating the ice cavity from the water cavity, the water cavity adjacent the ice cavity such that when warm water is poured in the water cavity, heat transfers from the rectilinear channels through the unmovable, inflexible, and rigid outermost walls and the unmovable, inflexible, and rigid floor to the ice cavity and begins to melts the ice cube thereby loosening outer outermost faces of the ice cube from the unmovable, inflexible, and rigid outermost walls and the unmovable, inflexible, and rigid floor;

automatically removing the ice cube from the ice cavity without movement of the unmovable, inflexible, and rigid floor and the unmovable, inflexible, and rigid outermost walls when the ice tray is manually rotated so that the water cavity faces upward and the ice cavity faces downward; and retrieving the ice cube.

* * * * *